US008128350B2

(12) United States Patent
Schiavo et al.

(10) Patent No.: US 8,128,350 B2
(45) Date of Patent: Mar. 6, 2012

(54) STACKED LAMELLAE CERAMIC GAS TURBINE RING SEGMENT COMPONENT

(75) Inventors: Anthony L. Schiavo, Oviedo, FL (US); Gary B. Merrill, Orlando, FL (US); Thomas B. Jackson, Portland, OR (US); Todd Willis, San Diego, CA (US)

(73) Assignee: Siemens Energy, Inc., Orlando, FL (US)

( * ) Notice: Subject to any disclaimer, the term of this patent is extended or adjusted under 35 U.S.C. 154(b) by 1392 days.

(21) Appl. No.: 11/928,407

(22) Filed: Oct. 30, 2007

(65) Prior Publication Data

US 2009/0081033 A1 Mar. 26, 2009

Related U.S. Application Data

(60) Provisional application No. 60/974,148, filed on Sep. 21, 2007.

(51) Int. Cl.
*F01D 11/08* (2006.01)

(52) U.S. Cl. ..... 415/173.1; 415/200

(58) Field of Classification Search ..... 415/173.1, 415/170.1, 173.4, 173.6, 174.4
See application file for complete search history.

(56) References Cited

U.S. PATENT DOCUMENTS

| | | | | |
|---|---|---|---|---|
| 3,880,435 | A * | 4/1975 | Thornbald | 277/416 |
| 6,197,424 | B1 | 3/2001 | Morrison et al. | |
| 7,153,096 | B2 | 12/2006 | Thompson et al. | |
| 2006/0120874 | A1 | 6/2006 | Burke et al. | |
| 2007/0128043 | A1 | 6/2007 | Morrison et al. | |
| 2007/0140835 | A1 | 6/2007 | Albrecht et al. | |

* cited by examiner

*Primary Examiner* — Richard Edgar

(57) ABSTRACT

A gas turbine ring segment (10) for use in gas turbine engines made from a ceramic matrix composite (CMC) material is disclosed. The ring segment includes a stacked multiplicity of CMC thin-sheet lamellae (25*a*, 25*b*) each comprising a peripheral surface collectively defining a cross-section profile of the ring segment. The lamellae collectively define a channel (11) formed in the center thereof for receiving a bow-tie member (27). The bow-tie member is disposed in the channel for holding together the stacked lamellae in a through thickness direction, and the in-plane strength of the bow-tie member is perpendicular to the in-plane strength of the lamellae. A stem portion (33) of the assembly may be further secured with a wrap (38) of CMC ribbon.

16 Claims, 4 Drawing Sheets

STACKED LAMELLAE CERAMIC GAS TURBINE RING SEGMENT COMPONENT

CROSS REFERENCE TO RELATED APPLICATIONS

This application claims benefit under 35 USC 119(e)(1) of the 21 Sep. 2007 filing date of U.S. provisional application 60/974,148, incorporated by reference herein.

FIELD OF THE INVENTION

The present invention generally relates to ring segments as may be used in gas turbine engines, and more particularly to components of such ring segments made from a ceramic matrix composite (CMC) material.

BACKGROUND OF THE INVENTION

As those skilled in the art are aware, the maximum power output of a combustion turbine is achieved by heating the gas flowing through the combustion section to as high a temperature as is feasible. The hot gas, however, heats the various turbine components, such as the combustor, transition ducts, vanes and ring segments, which it passes when flowing through the turbine.

Accordingly, the ability to increase the combustion firing temperature is limited by the ability of the turbine components to withstand increased temperatures. Consequently, various cooling methods have been developed to cool turbine hot parts. These methods include open-loop air cooling techniques and closed-loop cooling systems. Both techniques, however, require significant design complexity, have considerable installation and operating costs and often carry attendant losses in turbine efficiency.

In addition, various ceramic insulation materials have been developed to improve the resistance of turbine critical components to increased temperatures. Thermal Barrier Coatings (TBC's) are commonly used to protect critical components from elevated temperatures to which the components are exposed.

The first stage of turbine vanes direct the combustion exhaust gases to the airfoil portions of the first row of rotating turbine blades and their corresponding ring segments. A ring segment is a stationary gas turbine component, located between the stationary vane segments at the tip of a rotating blade or airfoil. These ring segments are subjected to high velocity, high temperature gases under high pressure conditions. In addition, they are complex parts with large surface areas and, therefore, are difficult to cool to acceptable temperatures. Conventional state-of-the-art first row turbine vanes and ring segments may be fabricated from single crystal super-alloy castings, may include intricate cooling passages, and may be protected with thermal barrier coatings. Ceramic matrix composites (CMC) have higher temperature capabilities than metal alloys. By utilizing such materials, cooling air can be reduced, which has a direct impact on engine performance, emissions control, and operating economics.

One of the limitations of CMC materials, whether oxide or non-oxide based, is that their strength properties are not uniform in all directions (e.g., the inter-laminar tensile strength is less than 5 percent of the in-plane strength). Anisotropic shrinkage of matrix fibers results in de-lamination defects in small radius corners and tightly curved sections, further reducing the already low inter-laminar properties. Thus, the use of CMC materials for gas turbine components has been limited.

BRIEF DESCRIPTION OF THE DRAWINGS

The invention is explained in the following description in view of the drawings that show.

DETAILED DESCRIPTION OF THE INVENTION

The present invention is a ceramic matrix composite (CMC) ring segment utilizing a series of stacked and bonded flat CMC lamellae. The CMC material may be any such material known in the art. One example of a commercially available oxide fiber/oxide matrix CMC material is a Nextel 720 fiber/alumina matrix composite available from COI Ceramics, Inc. of San Diego, Calif. The individual stacked lamellae are machined to the desired shape then bound together, and held in place with a bowtie shaped plate of CMC material oriented to carry the inter-laminar loads of the stacked lamellae assembly. The structure of the present invention takes advantage of the strengths of the CMC two-dimensional lamella materials while overcoming their fundamental weakness, that is, low inter-laminar strength, by incorporating another plate oriented with a strong axis in the inter-laminar direction of the stacked assembly. Advantages of this design include ease of manufacture, repeatability, design robustness and flexibility.

Figure 1:
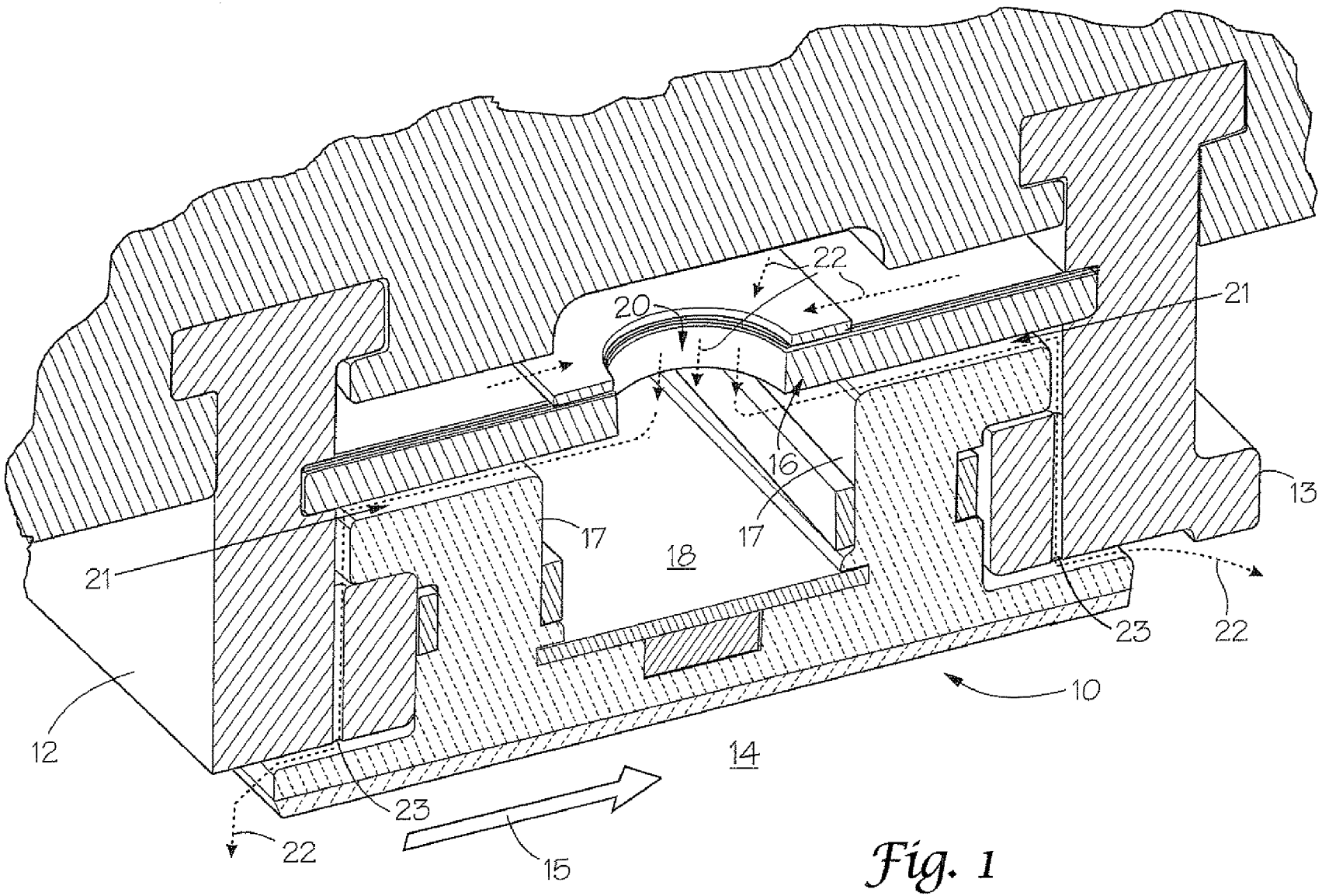
FIG. 1 is a cut-away perspective view of a coolant plenum structure including a portion of a ring segment in accordance with the present invention.

Referring now to the drawings and to FIG. 1 in particular, a cut-away perspective view of a portion of a coolant plenum structure including a ring segment 10 in accordance with one embodiment of the present invention is shown. The ring segment 10 is constructed of CMC material. The ring segment is held in place by a pair of isolation rings 12 and 13, which are manufactured of a metal alloy as may be known in the art. The isolation ring 12 is upstream relative to a flow of working gases 15 moving through a chamber 14 of the turbine structure, whereas isolation ring 13 is downstream relative to the working gas movement. The turbine blades (not shown) rotate in the space immediately below the ring segment within the chamber 14.

A seal 16 is disposed over the ceramic ring segment 10 between the isolation rings 12 and 13. The seal 16 and walls 17 of the ring segment 10 create a plenum 18, which conducts a coolant for the structure. The coolant is directed into the plenum 18 through one or more openings 20 formed in the seal assembly stack 16. The coolant is typically at a pressure substantially higher than that of the working gas 15, and passes through a small crevice 21 formed between the bottom of the assembly stack 16 and the top ledges of the ring segment 10, which movement is denoted by arrows 22. The coolant then passes through small orifices 23 formed in each of the isolation rings 12 and 13 and on to the working gas chamber 14.

Figure 2:
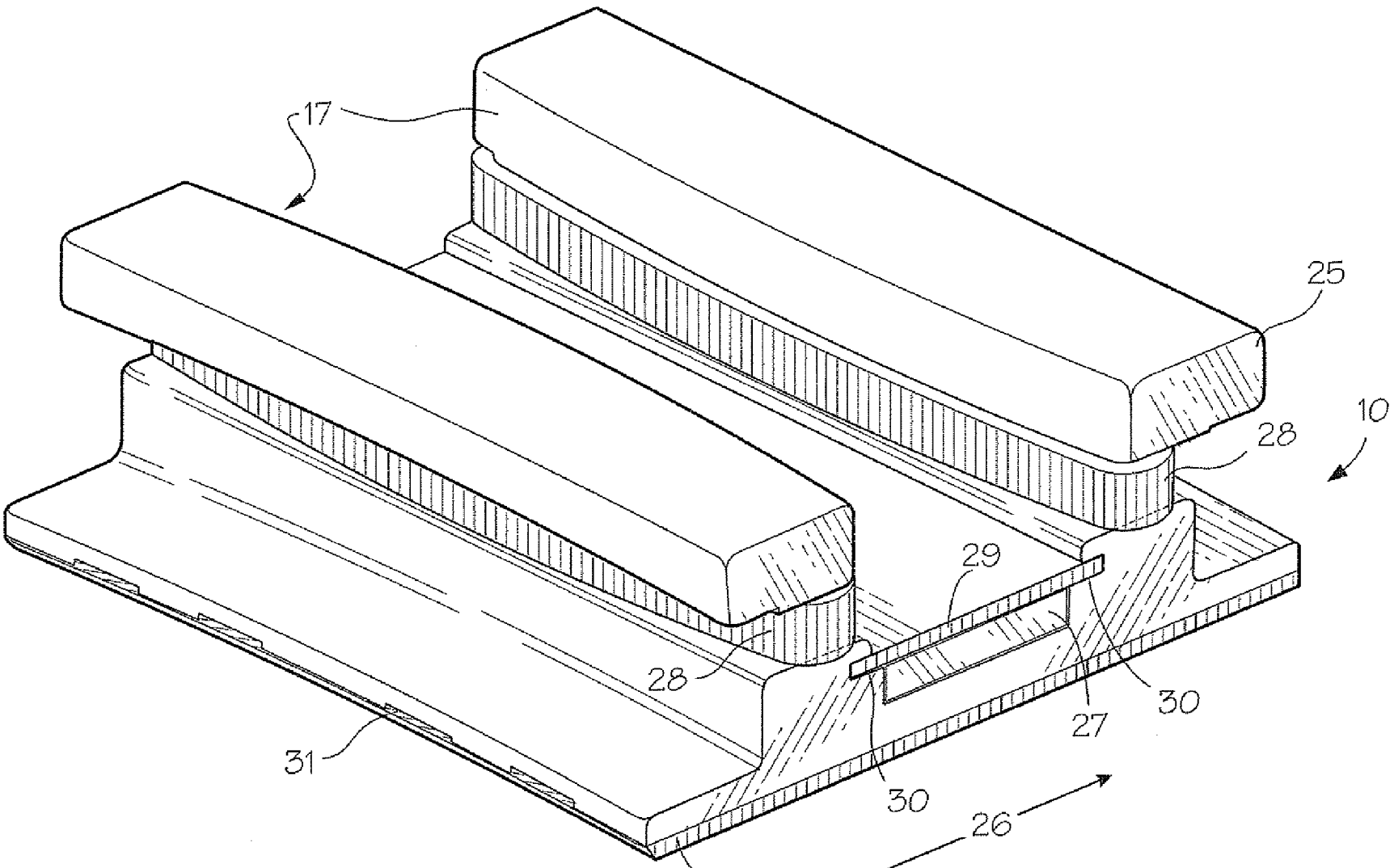
FIG. 2 is a perspective view of the stacked lamellae bowtie ring segment in accordance with the present invention.
Figure 3:
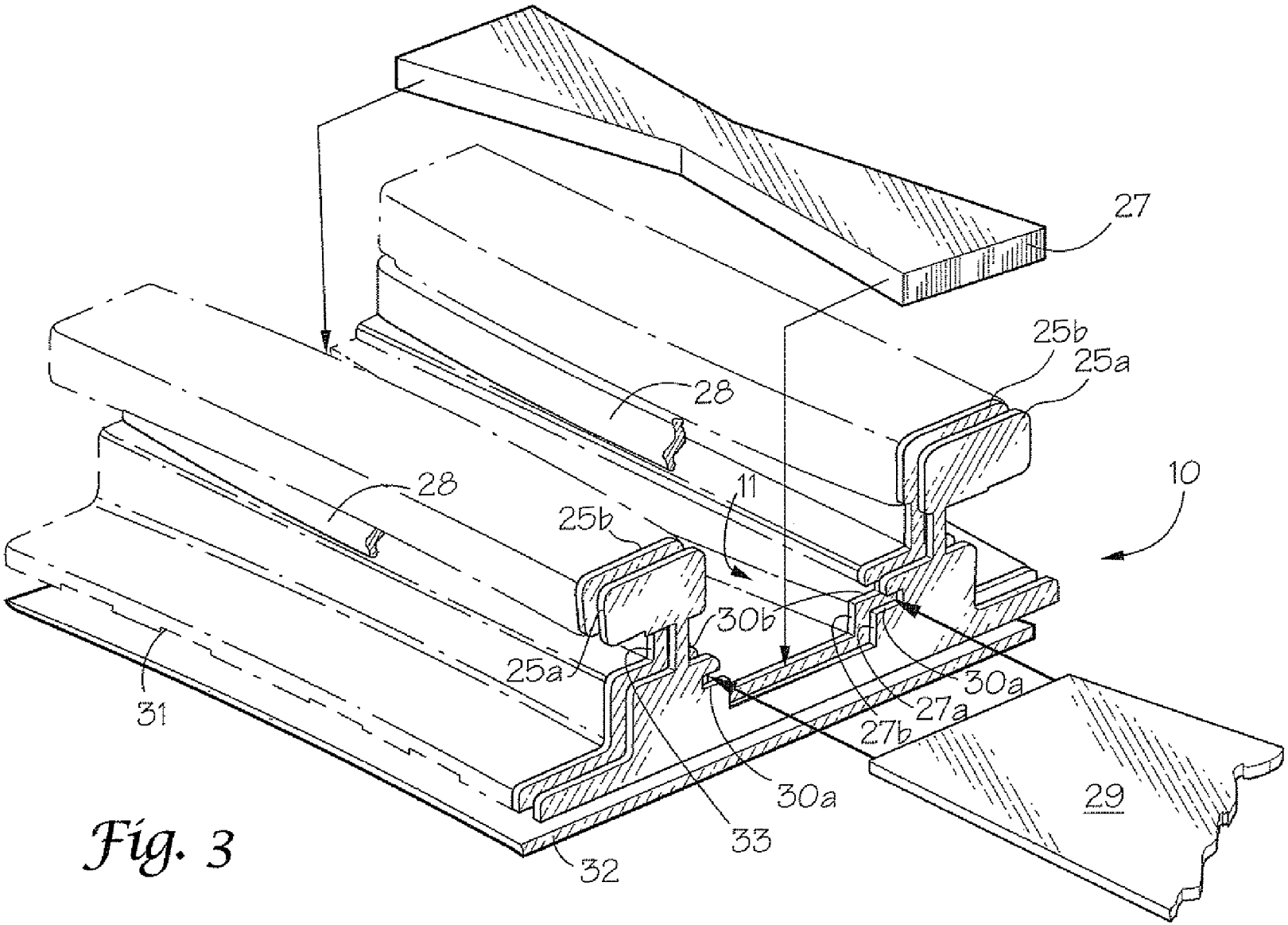
FIG. 3 is an exploded view of the stacked lamellae bowtie ring segment in accordance with the present invention.

With reference now to FIG. 2, a perspective view of the stacked lamellae bowtie ring segment 10 of FIG. 1 is shown. As stated hereinabove, the ring segment is made of CMC material and comprises several individual parts. First, there is the main structure 25, which is formed of a plurality of individual flat CMC lamellae bonded together (as will be shown in the exploded view of FIG. 3). The strongest plane of the CMC lamellae (i.e. plane of orientation of the reinforcing fibers of the 2-D fiber weave) is oriented in the plane of the lamellae and perpendicular to a longitudinal axis of the structure, as denoted by an arrow 26. Second, the individual lamellae are held together by a bowtie plate 27 and by wraps of CMC ribbons 28, both having their strongest planes (i.e. reinforcing fiber orientation) parallel to the longitudinal axis of the structure and perpendicular to the strong plane of the CMC lamellae (arrow 26). The bow-tie member 27 forms a double wedge that mechanically constrains the lamellae from separating when it is inserted into a cooperatively shaped double wedge channel 11 defined in the stacked assembly by channels 27*a*, 27*b*, . . . formed in the perimeter shape of the respective lamellae. Thus, each lamella may have a slightly different shape than its adjacent lamellae such that the assembly defines a double wedge shaped channel 11 into which the bow-tie member 27 can be lowered, as illustrated in FIG. 3. A top plate 29 is inserted over the bowtie 27 by sliding it into slots 30 to hold the bow-tie member 27 in the channel 11. the top plate 29 may also be a CMC member and the strong plane of the top plate may be parallel to the longitudinal axis of structure and perpendicular to the strong plane of the lamellae (arrow 26).

Once the individual lamellae are bound together to form the ring segment 10, the bottom surface 31 may be ground down to form an arc approximating the travel of the tips of the turbine rotor blades (not illustrated) in the chamber 14. Moreover, the surface may be left irregular—that is, it is not ground smooth, in order to receive a coating 32 of an abradable ceramic material, which is well known in the art. Abradable materials are used for high temperature insulation. Abradability is usually achieved by altering the density of the material. During operation of the turbine, rotation of the blades causes them to approach the abradable coating 32, and when heated, the blades expand slightly and the tips then contact the coating 32 and carve grooves in the coating without contacting the structural CMC portion of ring segment 10. These grooves provide a seal for the turbine blades.

Referring now to FIG. 3, an exploded view of the stacked lamellae bowtie ring segment 10 is shown. It may be appreciated from this exploded view that the main structure 25 is formed of a plurality of similar-shaped lamellae 25*a*, 25*b*, . . . , that are bonded together, such as with an adhesive or via a sintering process. The bow-tie structural member 27 is inserted into channel 11. The bow-tie 27 acts as a wedge for holding the individual lamellae 25*a*, 25*b*, . . . together. It is pointed out that the channel 11 is made progressively smaller toward the longitudinal center of the assembly. In this manner the channel is wider toward each end of the ring segment and more narrow toward the center, thereby forming the double wedge shaped channel 11 adapted for receiving the bow-tie member 27. The assembly and firing sequence for these parts provides a variety of possibilities for achieving favorable shrinkage of the bow-tie member 27 relative to the main structure 25 so that it induces compressive stresses across the stacked lamellae 25. Alternative materials can be used for the bow-tie member 27. For example, aluminosilicate matrix can used in cooler regions of the turbine where its superior bond strength and increased shrinkage can be use to advantage.

The top plate 29 is inserted into the slots 30 and on top of the bow-tie member 27. The CMC ribbons 28 are wrapped around the structure 25 at a stem 33 thereof. It is pointed out that the stem 33 is made progressively larger in a first half of each of the lamella and then progressively smaller in the second half of each of the lamella. In this manner the stem 33 is most narrow at each end and thickest at the center. Accordingly, a race track shape is formed for receiving the CMC ribbons 28, as may be seen in the top view of FIG. 4.

The bottom surface 31 of the structure 25 is ground down approximating the arc formed by the rotation of the tip of the turbine blade, and the abradable material layer 32 is deposited onto the ground bottom surface.

Figure 4:
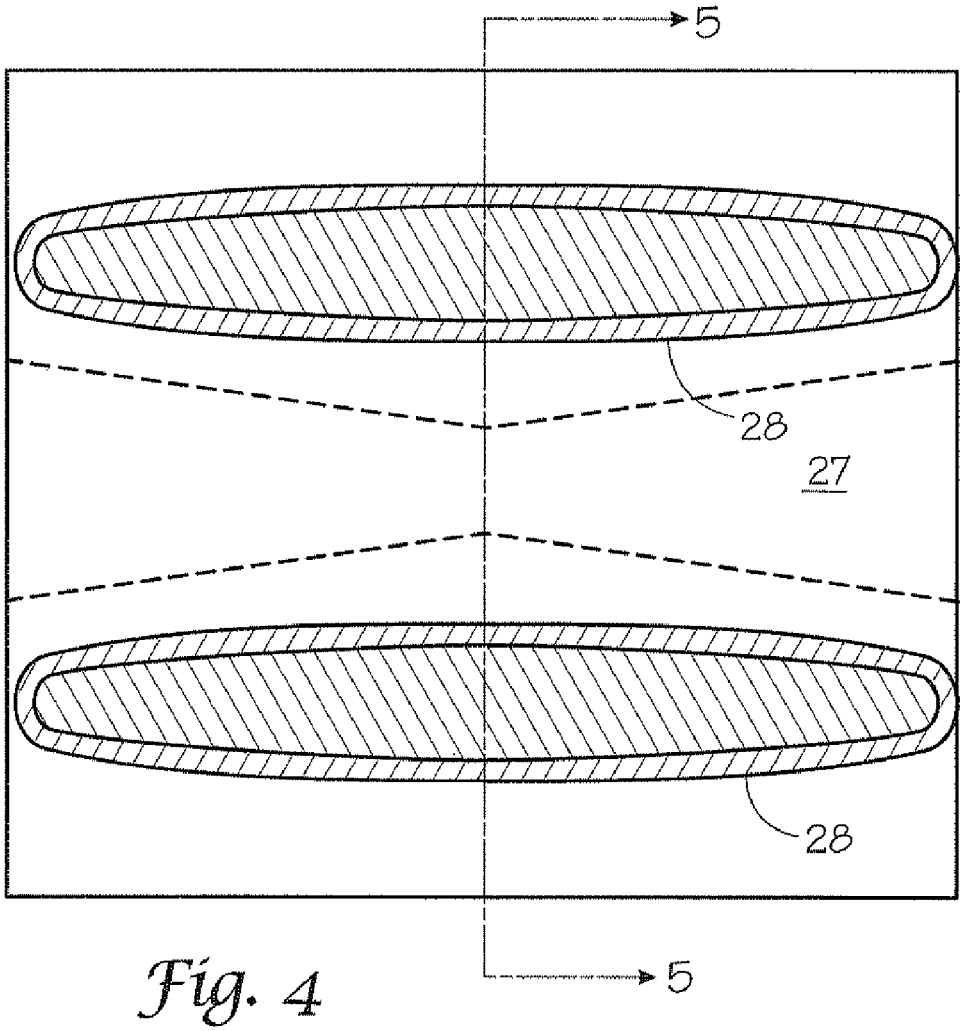
FIG. 4 is a top view of the stacked lamellae bowtie ring segment in accordance with the present invention, taken along the line 4-4 of FIG. 5.
Figure 5:
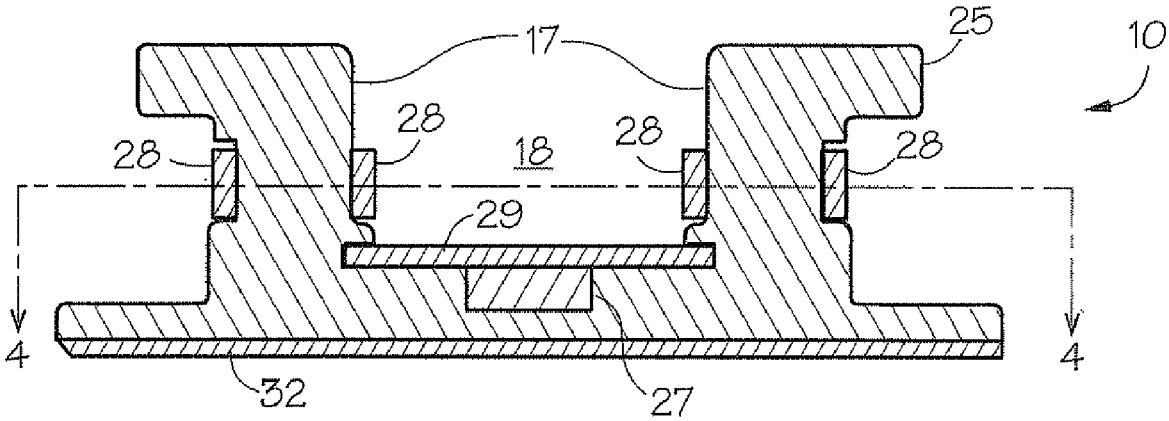
FIG. 5 is a cross-sectional view of the stacked lamellae bowtie ring segment in accordance with the present invention, taken along the line 5-5 of FIG. 4.

With reference now to FIG. 4, a top view of the stacked lamellae bowtie ring segment 10 taken along the line 4-4 of FIG. 5 is shown. The double wedge shape of the bow-tie structural member 27 is shown in dashed line. While the specific embodiment illustrated herein show a "double wedge shape" and "bow-tie" that are formed by generally symmetrical straight lines, it may be appreciated that these terms are meant to be generally descriptive of any such shape effective to constrain the lamellae from separating along the longitudinal axis. Other shapes that may be envisioned under the terms double wedge shape and bow-tie member may have curved lines or a combination of curved and straight lines or non-symmetrical lines, so long as the lamellae are prevented from separating from each other by the shape. It may be appreciated that the bow-tie member 27 functions as a wedge that mechanically constrains and holds together the individual lamellae 25*a*, 25*b*, . . . . Also, it may be appreciated from FIG. 4 that the wrap 28 around the varying width of the stem 33 forms a curved race-track shape that offers several benefits. First, the wrap 28 is not bent around sharp corners, which reduces stress concentrations at the ends. Second, the coolant air is free to move around the ends of the wrap 28; and, third the race-track shape helps distribute load during the manufacturing process.

With reference to FIG. 5, a cross-sectional view of the stacked lamellae bowtie ring segment 10, taken along the line 5-5 of FIG. 4, is shown. Accordingly, it may be appreciated from the discussion hereinabove that the use of thin-sheet lamellae 25*a*, 25*b*, . . . to fabricate the ring segment 10 enhances and simplifies the manufacturing process in that the lamellae are scalable and amenable to automation. Moreover, the thin-sheet lamellae are straight-forward to inspect for critical flaws. The complex outline shapes of the lamellae can be readily cut using programmable lasers or water jet methods. Additionally, it may be appreciated that the bond and inter-laminar weakness of the CMC lamellae stacks are overcome by the CMC bow-tie member 27 and/or wrap 28. By process sequencing or material selection for the bow-tie member 27 and/or wrap 28, compressively preloaded assemblies can be achieved in order to further minimize inter-laminar tensile stresses in the stacked lamellae 25. Finally, the use of the top plate 29, locked into place by the slots 30, prevents any buckling of the bow-tie member 27.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A gas turbine ring segment comprising:

a stacked multiplicity of ceramic matrix composite (CMC) lamellae each comprising a peripheral surface collectively defining a cross-section profile of said ring segment and collectively defining a double wedge shaped channel having a longitudinal axis generally perpendicular to planes of the respective lamellae; and a bow-tie member cooperatively shaped with and disposed in said channel for constraining the stacked lamellae along the longitudinal axis.

2. A ring segment as in claim 1, wherein the bow-tie member comprises a CMC material with its plane of greatest strength being oriented generally perpendicular to respective planes of greatest strength of the lamellae.

3. A ring segment as in claim 1, each lamella further comprising a stem portion, wherein said stem portions collectively define a race track shape.

4. A ring segment as in claim 3, further comprising a wrap of CMC material secured around the stems for securing together said lamellae.

5. A ring segment as in claim 4, wherein at least one of said bow-tie member and said wrap is differentially shrunk relative to the stacked lamellae, thereby compressively preloading said lamellae.

6. A ring segment as in claim 1, further comprising a top plate disposed in a slot defined by the stacked lamellae and holding the bow-tie member in the channel.

7. A gas turbine ring segment for use in gas turbine engines made from a ceramic matrix composite (CMC) material, said ring segment comprising:

a plurality of CMC lamellae stacked together along a longitudinal axis, each lamella comprising a peripheral surface collectively defining a cross-section profile and a wedge shaped channel of said ring segment, each lamella comprising an anisotropic CMC material exhibiting an in-plane strength perpendicular to the longitudinal axis substantially greater than a through thickness strength parallel to the longitudinal axis;

a bow-tie member disposed in said channel for resisting relative longitudinal movement of said lamella.

8. A ring segment as in claim 7, further comprising said bow-tie member comprising a CMC material being differentially shrunk relative to the stacked lamellae so as to exert a compressive pre-load.

9. A ring segment as in claim 7, wherein each lamella further comprises a stem collectively forming a race track shape.

10. A ring segment as in claim 9, further including a wrap of CMC material secured around the stem for securing together said lamellae in the through thickness direction.

11. A ring segment as in claim 10, wherein said wrap of CMC material is shrunk relative to the stacked lamellae stems to impose a compressive preload on the stacked lamellae.

12. A ring segment as in claim 7, further comprising a top plate disposed in a slot defined by the stacked lamellae to hold the bow-tie member in the groove.

13. A gas turbine ring segment for use in gas turbine engines made from a ceramic matrix composite (CMC) material, said ring segment comprising:

a stacked multiplicity of CMC thin-sheet lamellae each comprising a peripheral surface collectively defining a cross-section profile of said ring segment, each lamella having an anisotropic CMC material exhibiting an in-plane strength substantially greater than a through thickness tensile strength and having a symmetrical body shape with a channel formed in the center thereof;

a double wedge bow-tie CMC member disposed in said channel for resisting relative sliding movement associated with each of a subset of said lamella, the in-plane strength of said bow-tie member is perpendicular to the in-plane strength of said lamellae;

a CMC top plate covering said bow-tie member, said top having an in-plane strength parallel to said bow-tie member and perpendicular to the in-plane strength of said lamellae.

14. A ring segment as in claim 13, wherein each lamella further comprises a stem on either side thereof, wherein said stems being made progressively larger in a first one half of said lamella and then progressively smaller in a second one half of said lamella, such that said stacked stems are each collectively most narrow at each end of said ring segment and widest in the center thereby forming a respective race track shape.

15. A ring segment as in claim 14, further including a wrap of CMC material secured around each of said stacked stems for securing together said lamellae in the through thickness direction.

16. A ring segment as in claim 15, wherein said wrap of CMC material is shrinkable when cured under heat, thereby binding together said lamellae.

* * * * *